US005884566A

United States Patent [19]

Chen

[11] Patent Number: 5,884,566

[45] Date of Patent: Mar. 23, 1999

[54] ROLL-UP TABLE TOP ASSEMBLY

[76] Inventor: Kao-San Chen, No. 282, Sec. 2, Shu-Lin St., Tainan City, Taiwan

[21] Appl. No.: 887,003

[22] Filed: Jul. 2, 1997

[30] Foreign Application Priority Data

Jul. 9, 1996 [TW] Taiwan ..... 85210406

[51] Int. Cl.[6] ..... A47B 1/06

[52] U.S. Cl. ..... 108/67; 160/229.1

[58] Field of Search ..... 108/67, 68, 115, 108/43; 160/235, 279.1

[56] References Cited

U.S. PATENT DOCUMENTS

| | | | |
|---|---|---|---|
| 492,284 | 2/1893 | Graaff et al. | 108/68 |
| 2,583,878 | 1/1952 | Plym | 160/235 |
| 2,642,018 | 6/1953 | Weeber | 160/235 X |
| 2,726,911 | 12/1955 | Mason | 108/68 X |
| 2,739,730 | 3/1956 | Jonas | 160/235 X |
| 4,341,164 | 7/1982 | Johnson | 108/67 |
| 4,532,973 | 8/1985 | DeFalco | 160/235 |
| 4,634,172 | 1/1987 | Duda | 160/235 X |
| 4,807,921 | 2/1989 | Champie, III et al. | 160/235 X |
| 4,958,577 | 9/1990 | Demaio et al. | 108/67 X |
| 5,372,175 | 12/1994 | Calhoun et al. | 160/235 |

FOREIGN PATENT DOCUMENTS

| | | | |
|---|---|---|---|
| 104977 | 7/1942 | Sweden | 108/68 |

*Primary Examiner*—Jose V. Chen

[57] ABSTRACT

A roll-up table top assembly includes a plurality of slats that are disposed side by side, and a plurality of coupling units. Each of the slats has opposed parallel longitudinal sides. Each of the coupling units couples pivotally an adjacent pair of the slats, and includes a first coupling member and a second coupling member. The first coupling member is formed integrally on one of the longitudinal sides of one of the slats and includes a connecting portion and a cylindrical mounting shaft portion formed on the connecting portion. The second coupling member is formed integrally on one of the longitudinal sides of another one of the slats and includes a resilient coupling ring which has an axially extending notch with a size smaller than the diameter of the mounting shaft portion of the first coupling member. The mounting shaft portion of the first coupling member is extendible into the coupling ring via the notch to couple pivotally the adjacent pair of slats.

3 Claims, 6 Drawing Sheets

ROLL-UP TABLE TOP ASSEMBLY

BACKGROUND OF THE INVENTION

1. Field of the Invention

The present invention relates to a roll-up table top assembly, more particularly to a roll-up table top assembly which includes coupling units that render the table top assembly easier to manufacture and assemble and that imparts enhanced rigidity to the table top assembly when the table top assembly is unrolled.

2. Description of the Related Art

Referring to FIGS. 1 and 2, a conventional roll-up table top assembly 1 is shown to include a plurality of parallel slats 11, three connecting straps 12 and a plurality of mounting plates 13. The slats 11 are formed integrally from plastic and have a top wall 111, a surrounding wall 112 extending downwardly from the periphery of the top wall 111, and three longitudinally extending reinforcing ribs 113 connected to the top wall 111 and the surrounding wall 112. Each of the slats 11 has three spaced positioning units 117, each of which includes four downwardly extending positioning tubes 114 which are arranged in a rectangular configuration and teeth 116 formed between adjacent pairs of the positioning tubes 114. Two adjacent ones of the positioning tubes 114 of each of the positioning units 117 are formed on an outer one of the reinforcing ribs 113 that is disposed adjacent to one of the longitudinal sides of the surrounding wall 112. The other two adjacent ones of the positioning tubes 114 are formed on an opposite outer one of the reinforcing ribs 113 that is disposed adjacent to the other one of the longitudinal sides of the surrounding wall 112. Each of the positioning tubes 114 confines an axial positioning hole 115. The connecting straps 12 are made of a flexible material. Each of the connecting straps 12 extends transversely across bottom sides of the parallel slats 11, and is disposed between the positioning tubes 114 of corresponding positioning units 117 of the parallel slats 11. Each of the mounting plates 13 is rectangular in shape and is formed with four positioning posts 132 at four corners thereof. The mounting plates 13 are formed with teeth 133 and are disposed under the connecting straps 12. The posts 132 of each of the mounting plates 13 extend into the axial positioning holes 115 of the positioning tubes 114 of a corresponding one of the positioning units 117 so that the connecting straps 12 are retained between the teeth 133 of the mounting plates 13 and the teeth 116 of the positioning unit 117 in order to mount the slats 11 on the connecting straps 12.

To assemble the table top assembly 1, the slats 11 are disposed side by side, and the connecting straps 12 are disposed at the bottom sides of the slats 11 so that each of the connecting straps 12 extends transversely relative to the slats 11 between the positioning tubes 114 of the corresponding positioning units 117. Glue is applied to the posts 132 of each of the mounting plates 13, and the mounting plates 13 are then pressed onto the positioning units 117 to engage the posts 132 with the corresponding positioning tubes 114. The connecting straps 12 are thus sandwiched and retained between the mounting plates 13 and the positioning units 117 for connecting the slats 11 side by side to each other. Assembly of the table top assembly 1 is thus completed. The table top assembly 1 can either be unrolled and supported on a leg assembly 14 for placing objects thereon, as shown in FIG. 3, or rolled-up for storage or transport.

Although the table top assembly 1 can be conveniently rolled-up and unrolled for use, the table top assembly 1 is still not satisfactory for the following reasons:

1. Since the slats 11 of the table top assembly 1 are connected to one another by means of the flexible connecting straps 12, a localized indented part might be formed on the table top assembly 1 when pressure is applied to that part. In other words, the aforementioned table top assembly 1 does not posses sufficient rigidity.
2. The slats 11 are mounted on the connecting straps 12 by means of a plurality of mounting plates 13 that have positioning posts 132 which extend into the positioning tubes 114 of the slats 11. The slats 11, the connecting straps 12 and the mounting plates 13 should be manufactured separately. Therefore, the manufacturing of the table top assembly 1 is complicated, and the assembly thereof is relatively troublesome.
3. Since the slats 11 are connected by means of the connecting straps 12, the distance between adjacent pairs of the slats 11 cannot be controlled precisely. As such, the slats 11 tend to have a somewhat disorderly arrangement.

SUMMARY OF THE INVENTION

The main object of the present invention is to provide a roll-up table top assembly which can be conveniently manufactured and assembled, and which has improved rigidity and a more orderly appearance as compared to the aforementioned prior art.

Accordingly, the roll-up table top assembly of this invention is adapted to be supported on a leg assembly and includes a plurality of slats and a plurality of coupling units, The slats are disposed side by side, and each of the slats has opposed parallel longitudinal sides. Each of the coupling units couples pivotally an adjacent pair of the slats, and includes a first coupling member and a second coupling member. The first coupling member is formed integrally on one of the longitudinal sides of one of the slats and includes a connecting portion which projects transversely from said one of the longitudinal sides, and a cylindrical mounting shaft portion which is formed on the connecting portion and which extends along a direction parallel to said one of the longitudinal sides. The second coupling member is formed integrally on one of the longitudinal sides of another one of the slats. The second coupling member includes a coupling ring which has an axis parallel to said one of the longitudinal sides of said another one of the slats, and an axially extending notch with a size smaller than the diameter of the mounting shaft portion of the first coupling member. The coupling ring is made of a resilient material. The mounting shaft portion of the first coupling member is extendible into the coupling ring via the notch to couple pivotally the adjacent pair of slats.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
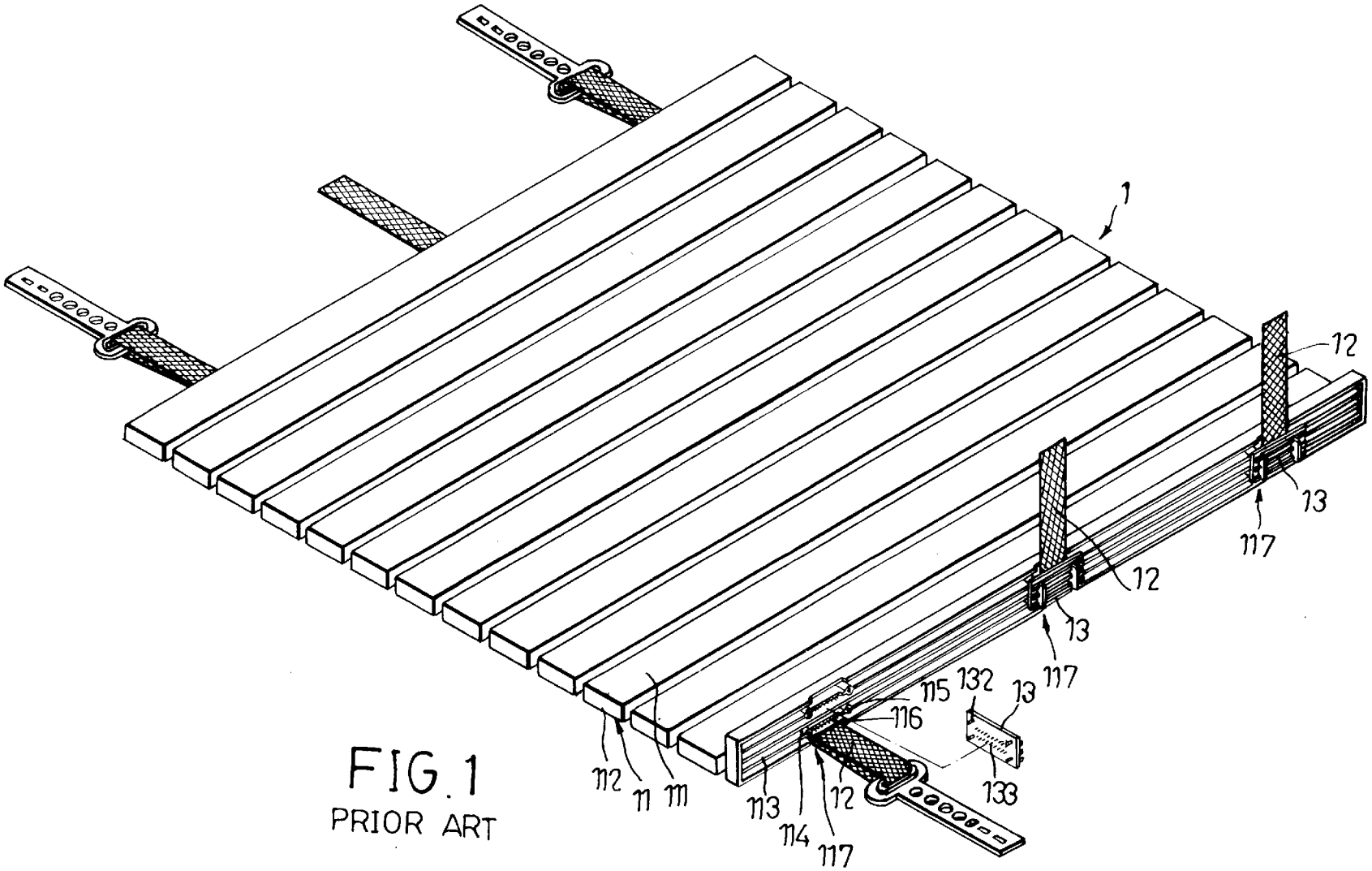
FIG. 1 PRIOR ART
FIG. 1 is a perspective view of a conventional roll-up table top assembly.
Figure 2:
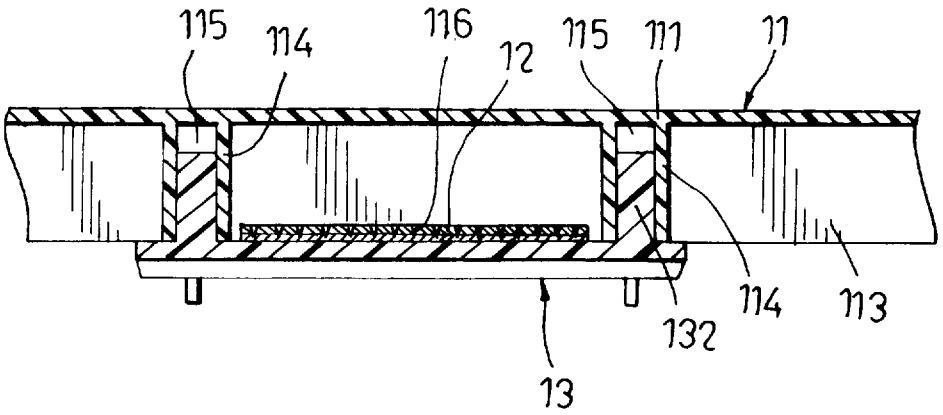
FIG. 2 PRIOR ART
FIG. 2 is a sectional view of a part of the table top assembly of FIG. 1.
Figure 3:
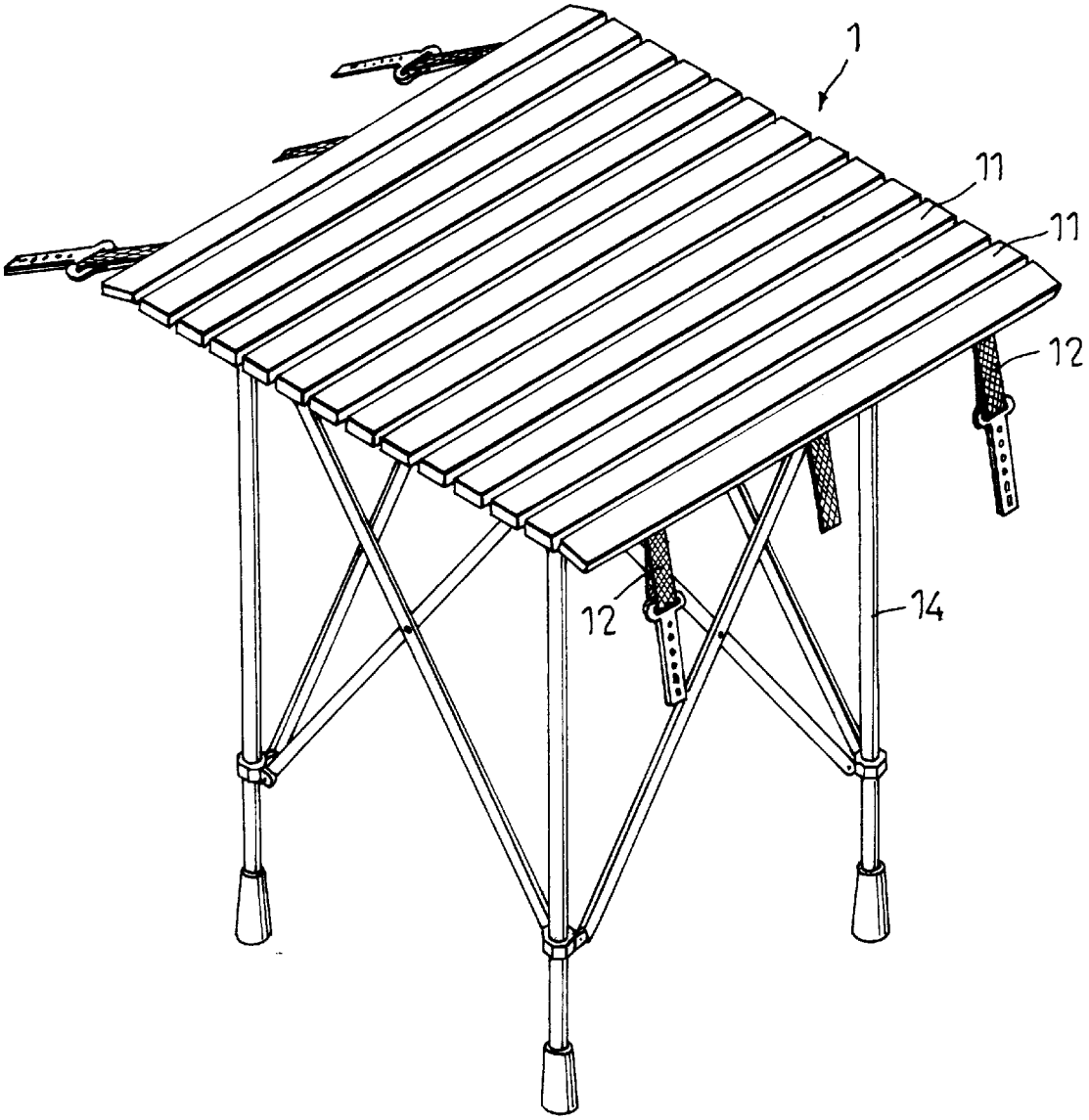
FIG.3 PRIOR ART
FIG. 3 illustrates the table top assembly of FIG. 1 when supported on a leg assembly.
Figure 4:
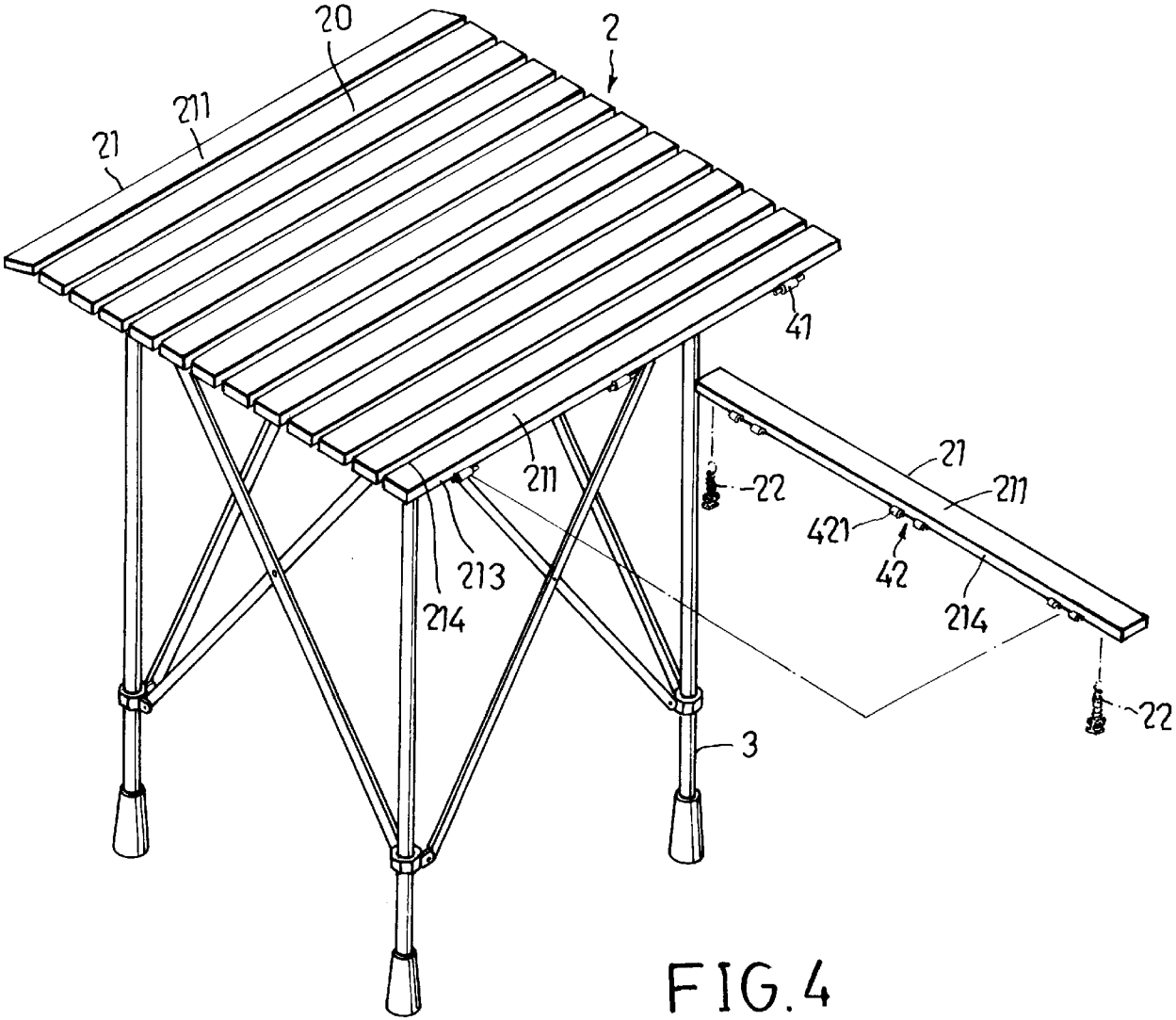
FIG. 4 is a partly exploded perspective view which illustrates a roll-up table top assembly according to a preferred embodiment of the present invention when supported on a leg assembly.
Figure 5:
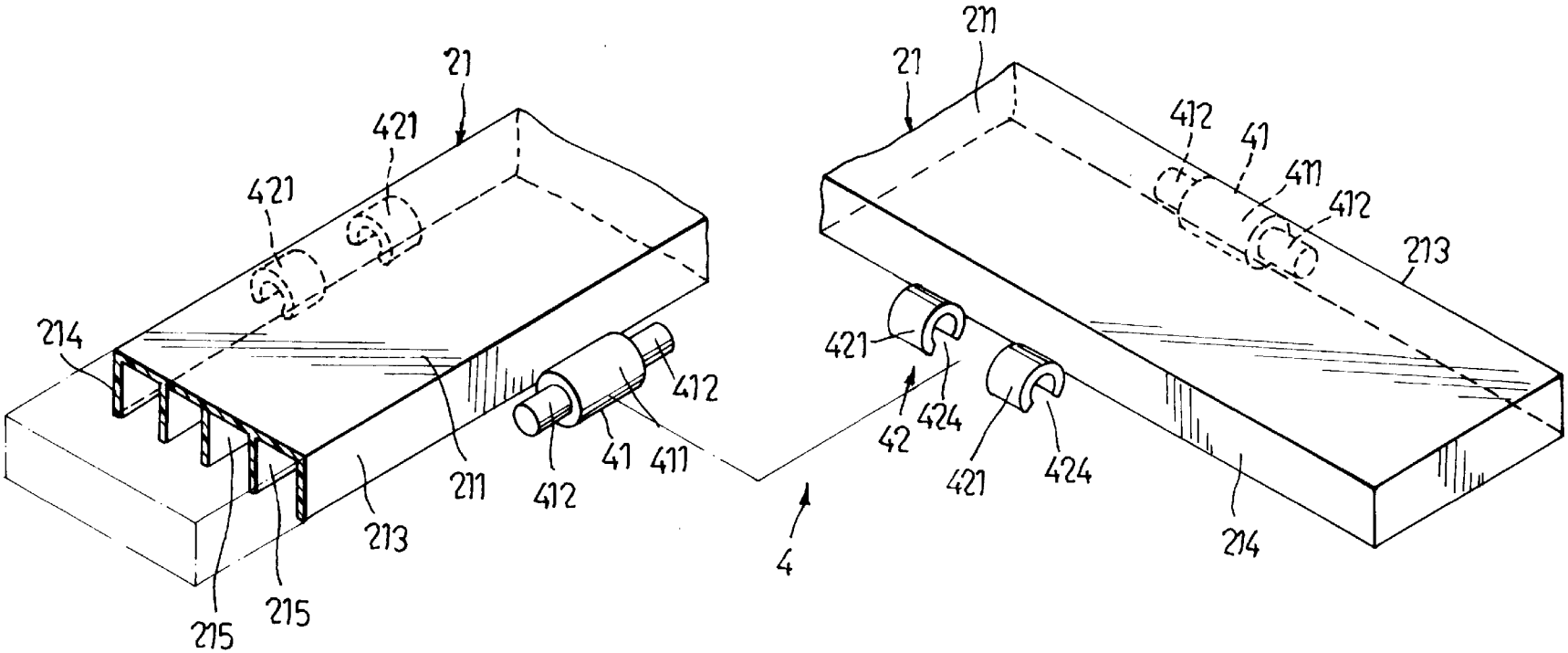
FIG. 5 is an enlarged exploded perspective view illustrating the connection between the slats of the table top assembly of FIG. 4.

Referring to FIGS. 4 and 5, the roll-up table top assembly 2 according to the preferred embodiment of the present invention is shown to be adapted to be supported on a leg assembly 3 so as to form a horizontal top surface 20 on the leg assembly 3 for placing objects thereon. The table top assembly 2 includes a plurality of parallel slats 21 which are disposed side by side. Each of the slats 21 has a top wall 211, opposed parallel first and second longitudinal sides 213, 214 and a plurality of longitudinal reinforcing ribs 215 connected to the top wall 211 and disposed between the first and second longitudinal sides 213, 214. The table top assembly 2 further includes a plurality of coupling units 4. Every adjacent pair of the slats 21 are coupled pivotally by at least two of the coupling units 4. In this embodiment, every adjacent pair of the slats 21 are coupled by three coupling units 4. Each of the coupling units 4 includes a first coupling member 41 and a second coupling member 42. The first coupling member 41 is formed integrally on the first longitudinal side 213 of one of the slats 21. The first coupling member 41 includes a cylindrical connecting portion 411 which projects transversely from the first longitudinal side 213, and two cylindrical mounting shafts 412 which are formed respectively on opposite ends of the connecting portion 411. Each of the cylindrical mounting shafts 412 extends along a direction parallel to the first longitudinal side 213, and has a diameter smaller than that of the connecting portion 411. The second coupling member 42 is formed integrally on the second longitudinal side 214 of an adjacent one of the slats 21. The second coupling member 42 includes two coupling rings 421, each of which has an axis parallel to the second longitudinal side 214 and an axially extending notch 424 that opens downwardly and that has a size smaller than the diameter of a corresponding one of the mounting shaft portions 412. The coupling rings 421 of the second coupling member 42 are spaced apart by a distance equal to the length of the connecting portion 411 of the first coupling member 41 so as to prevent relative longitudinal movement between the adjacent pair of the slats 21 to ensure firm coupling therebetween. Optionally, a pair of spring-loaded hook members 22 can be provided on the two outermost ones of the slats 21 for hooking the leg assembly 3 in order to prevent removal of the table top assembly 2 from the leg assembly 3.

Figure 6:
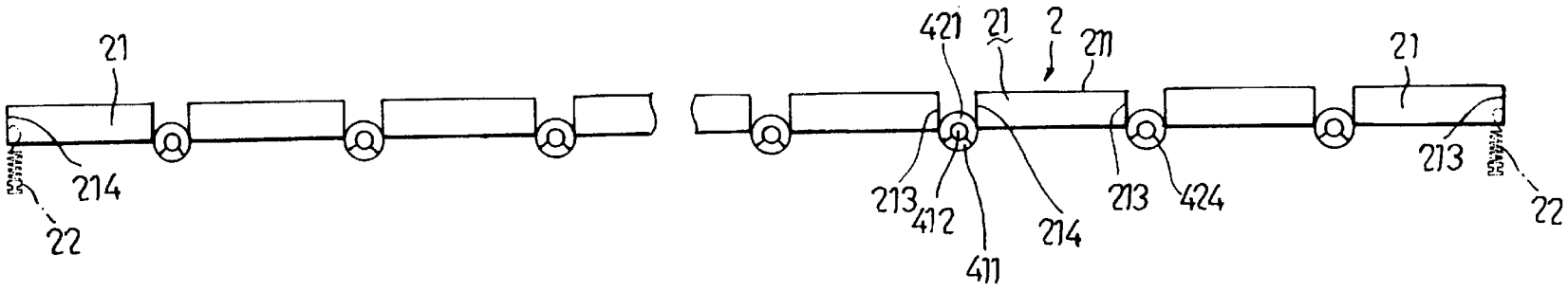
FIG. 6 is a front view of the table top assembly of FIG. 4.

Referring to FIGS. 4 and 6, when manufacturing the table top assembly 2 of the preferred embodiment, each of the slats 21 is formed from plastic and is formed integrally with three of the first coupling members 41 at the first longitudinal side 213 thereof and three of the second coupling members 42, each of which includes two spaced coupling rings 421, at the second longitudinal side 214 thereof. To assemble the table top assembly 2, a first one of the slats 21 and an adjacent second one of the slats 21 are disposed side by side to each other so that each of the mounting shaft portions 412 of the first coupling members 41 formed on the first longitudinal side 213 of the first slat 21 are disposed immediately under a corresponding one of the notches 424 of the coupling rings 421 of the second coupling members 42 formed on the second longitudinal side 214 of the second slat 21. The first coupling members 41 and the second coupling members 42 are then pressed together so that each of the mounting shaft portions 412 of the first coupling members 41 extends into a corresponding one of the coupling rings 421 of the second coupling members 42 via a corresponding one of the notches 424. The pressing step can be performed mechanically in a mold. The mounting shaft portions 412 of the first coupling members 41 are thus coupled pivotally and resiliently with the coupling rings 421 of the second coupling member 42, thereby coupling the first and second slats 21. Succeeding ones of the slats 21, in turn, are sequentially assembled to form the table top assembly 2. After assembly, the first coupling members 41 and the second coupling members 42 that protrude respectively from the outermost two of the slats 21 may either be cut to leave flat side surfaces, or be retained to permit future assembly of additional slats 21.

Accordingly, the table top assembly 2 of this invention has the following advantages as compared to the aforementioned conventional table top assembly 1:

1. The table top assembly 2 has improved rigidity since the coupling units 4 are formed integrally with the slats 21. Thus, the presence of localized indented parts on the table top assembly 2 can be avoided when the latter is in use.
2. The manufacturing and assembly of the table top assembly 2 are easier to accomplish.
3. The distance between any adjacent pair of the slats 21 can be controlled precisely since the first and second coupling members 41, 42 can be precisely formed on the slats 21 when the latter are manufactured.

With this invention thus explained, it is apparent that numerous modifications and variations can be made without departing from the scope and spirit of this invention. It is therefore intended that this invention be limited only as indicated in the appended claims.

I claim:

1. A roll-up table top assembly adapted to be supported on a leg assembly, said table top assembly comprising:

a plurality of parallel slats which are disposed side by side, each of said slats having opposed parallel longitudinal sides; and a plurality of coupling units, each of which couples pivotally an adjacent pair of said slats, and includes:

a first coupling member formed integrally on one of said longitudinal sides of one of said slats, said first coupling member including a connecting portion which projects transversely from said one of said longitudinal sides, and two cylindrical mounting shaft portions which are formed respectively on two opposite ends of said connecting portion and which extend along a direction parallel to said one of said longitudinal sides, each of said mounting shaft portions having a diameter smaller than cross-section of said connecting portion; and a second coupling member formed integrally on one of said longitudinal sides of another one of said slats, said second coupling member including two coupling rings which have an axis parallel to said one of said longitudinal sides of said another one of said slats, each of said coupling rings having an axially extending notch with a size smaller than the diameter of a respective one of said mounting shaft portions of said first coupling member, said coupling rings being made of a resilient material, said mounting shaft portions of said first coupling member being extendable into a respective one of said coupling rings via the respective notch to couple pivotally said adjacent pair of said slats, said coupling rings of said second coupling member being spaced apart by a distance equal to length of said connecting portion of said first coupling member so as to prevent relative longitudinal movement between said adjacent pair of said slats.

2. The roll-up table top assembly according to claim 1, wherein each of said slats has first and second longitudinal sides, said first coupling member and said second coupling member of said coupling units being formed respectively on said first and second longitudinal sides of said slats.

3. The roll-up table top assembly according to claim 1, wherein every said adjacent pair of said slats are coupled pivotally by at least two of said coupling units.

* * * * *